US005897472A

United States Patent [19]

Thulasingam

[11] Patent Number: 5,897,472

[45] Date of Patent: Apr. 27, 1999

[54] ABDOMINAL EXERCISE APPARATUS FEATURING PRESTRETCHING AND WEIGHT TRAINING FACILITIES

[76] Inventor: Suresh Thulasingam, #2, 5th Main Road, Kannan Nagar, 600 091, India

[21] Appl. No.: 08/925,154

[22] Filed: Sep. 8, 1997

[51] Int. Cl.[6] ..... A63B 23/02; A47C 7/42

[52] U.S. Cl. ..... 482/133; 482/103; 482/140; 482/142; 482/907; 297/284.4; 297/452.3

[58] Field of Search ..... 482/99, 102, 103, 482/130, 133–140, 142, 907; D21/673, 675, 687, 690, 695; 297/284.4, 284.5, 452.3, 452.31, 452.32; 601/24

[56] References Cited

U.S. PATENT DOCUMENTS 3,542,421 11/1970 Ambrose ..... 297/284.5
4,372,553 2/1983 Hatfield .
5,120,052 6/1992 Evans .
5,470,291 11/1995 Pekkanen .
5,542,898 8/1996 Wilkinson .
5,573,485 11/1996 Geschwender ..... 482/142

*Primary Examiner*—John Mulcahy
*Attorney, Agent, or Firm*—Michael I. Kroll

[57] ABSTRACT

An abdominal exercise apparatus (52) comprising an adjustable upright stand (54). A multi-contoured back pad base structure (56) is for positioning, preparing and isolating various muscles of the abdomen of a person (58) during exercise. A component (60) is for mounting the multi-contoured back pad base structure (56) to the adjustable upright stand (54), so that a back (62) of the person (58) can be placed against the multi-contoured back pad base structure (56). A force resistance assembly (64) is affixed onto a top end of the adjustable upright stand (54). A facility (66) is for connecting an upper body (68) of the person (58) to the force resistance assembly (64). When the person (58) moves forwardly away from the multi-contoured back pad base structure (56), the force resistance assembly (64) will apply a force resistance to the upper body (68) of the person (58), to exercise the abdominal muscles of the person (58).

16 Claims, 12 Drawing Sheets

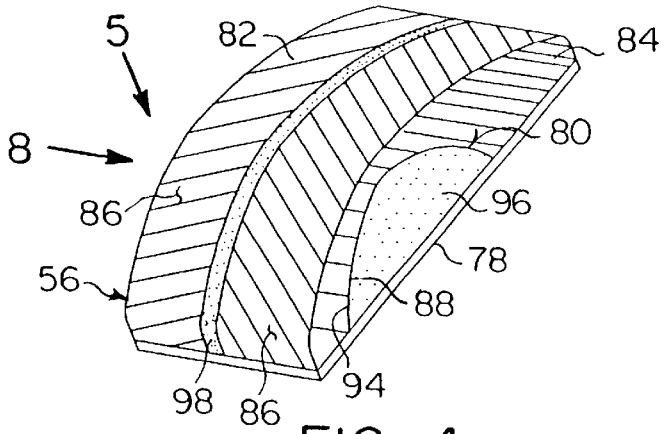
FIG. 4
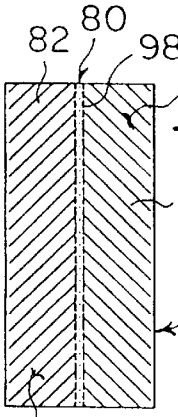
FIG. 5
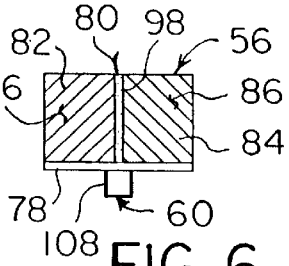
FIG. 6
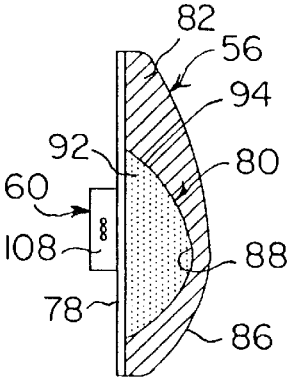
FIG. 8
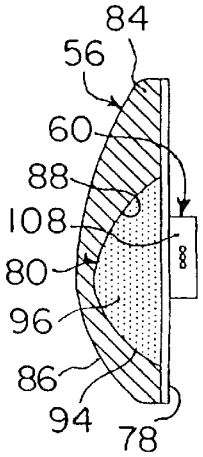
FIG. 7
FIG. 9
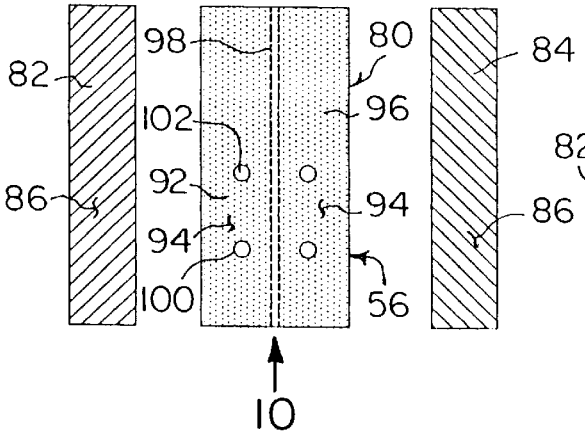
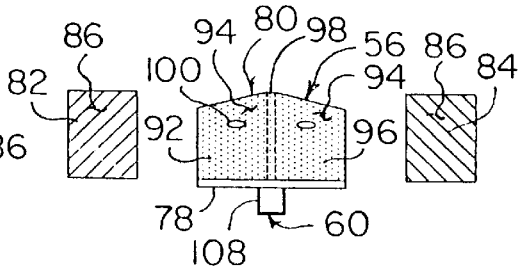
FIG. 10

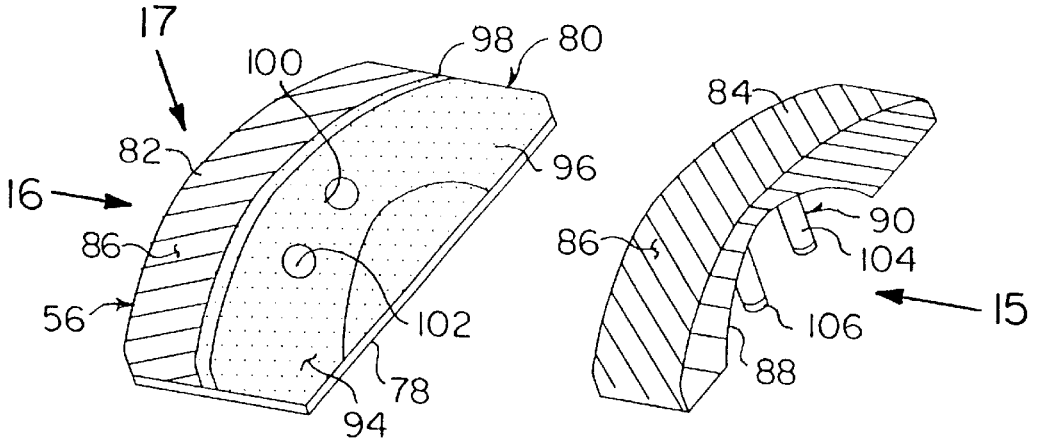
FIG. 14
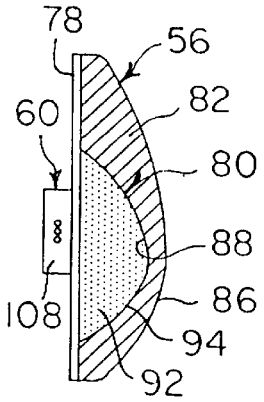
FIG. 16
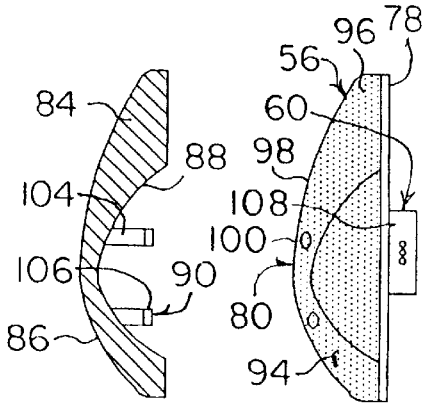
FIG. 15
FIG. 17
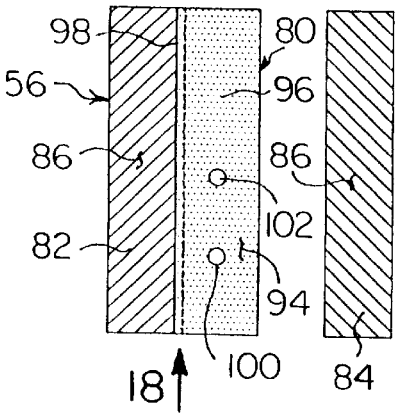
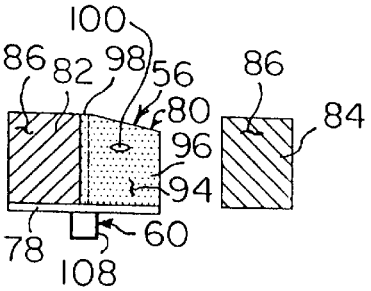
FIG. 18

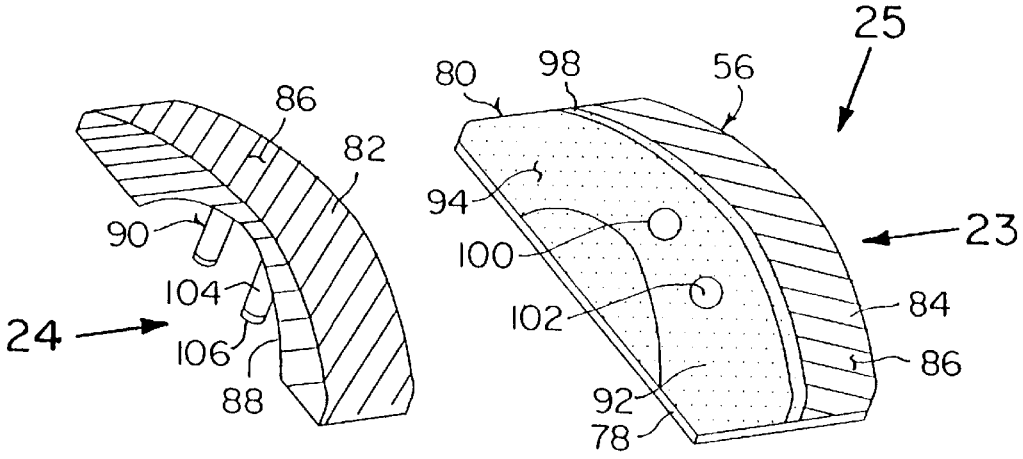
FIG. 22
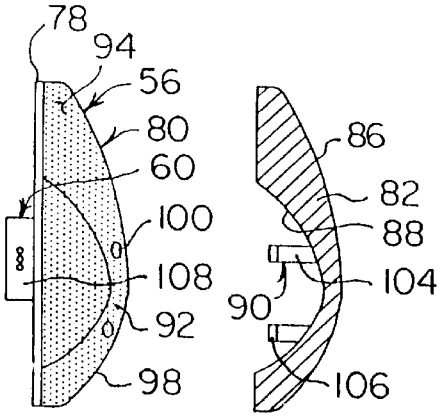
FIG. 24
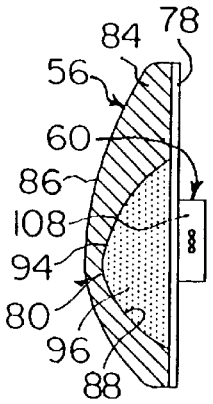
FIG. 23
FIG. 25
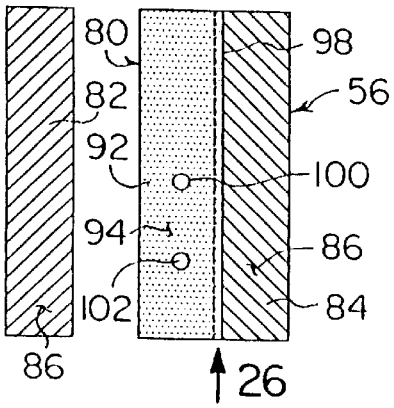
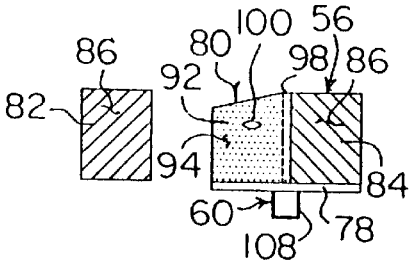
FIG. 26

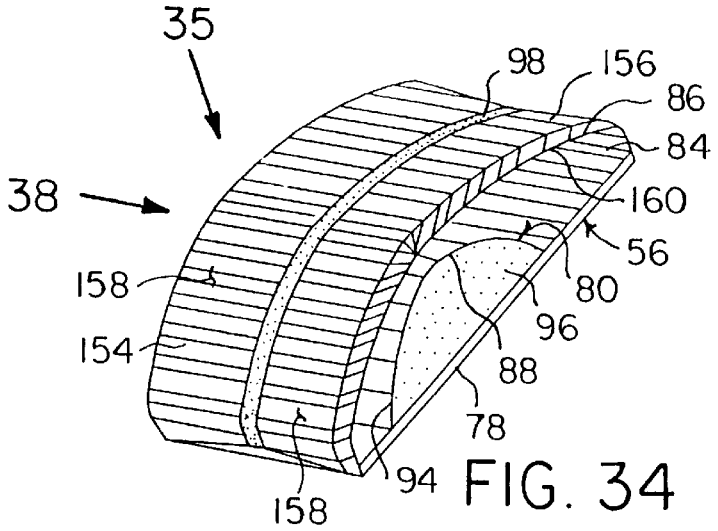
FIG. 34
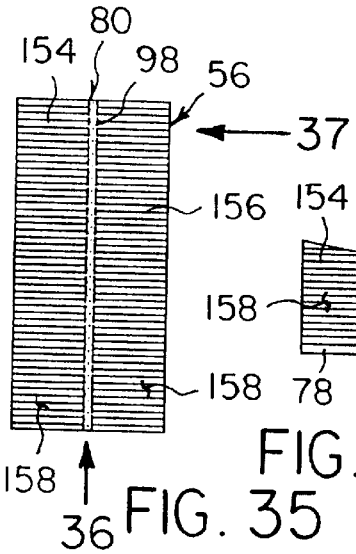
FIG. 35
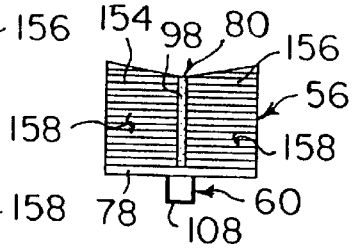
FIG. 36
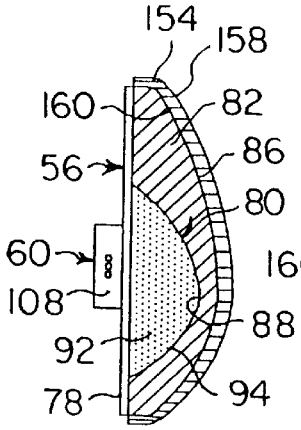
FIG. 38
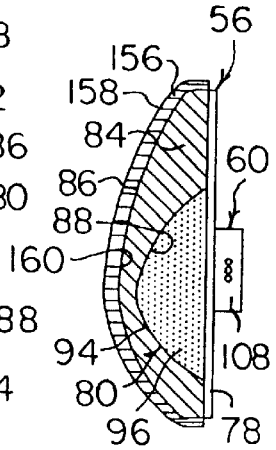
FIG. 37
FIG. 39
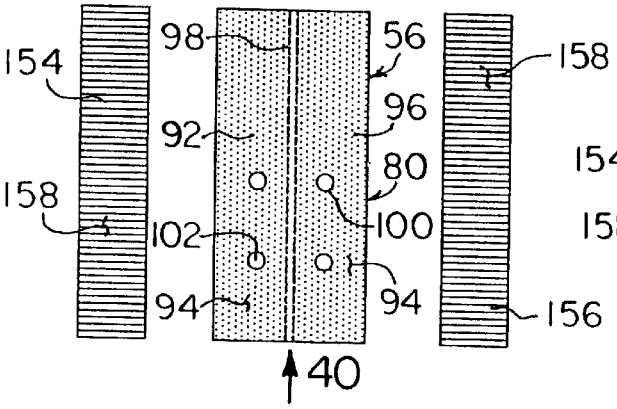
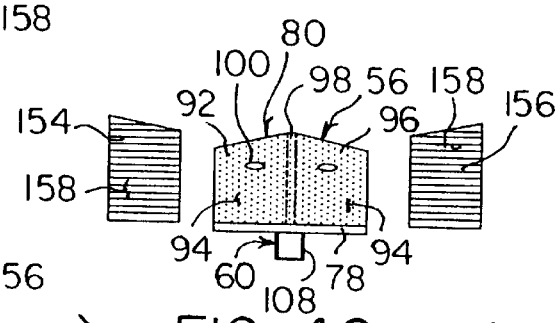
FIG. 40

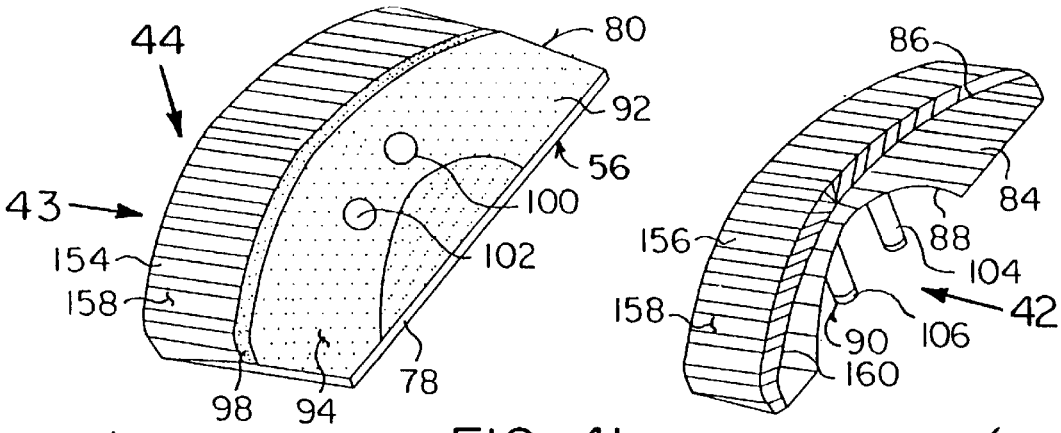
FIG. 41
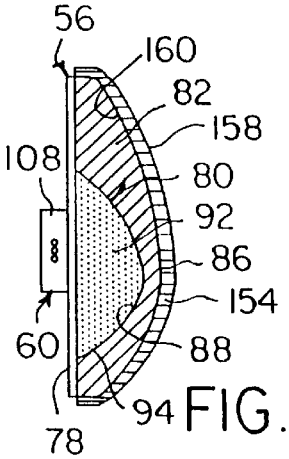
FIG. 43
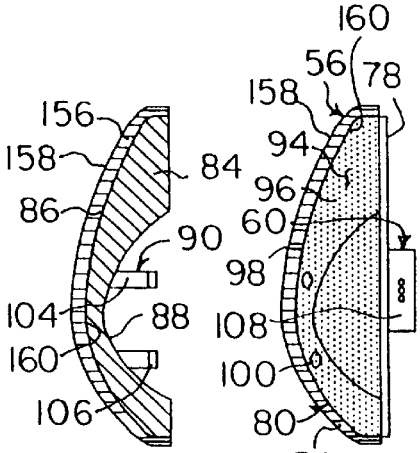
FIG. 42
FIG. 44
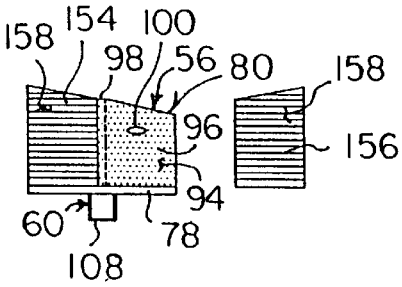
FIG. 45
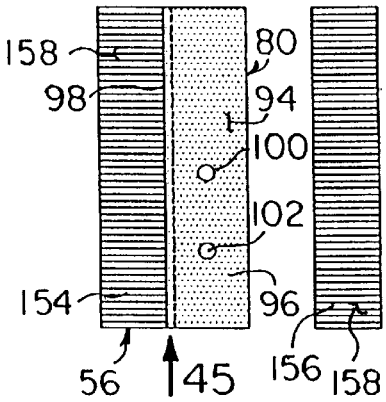

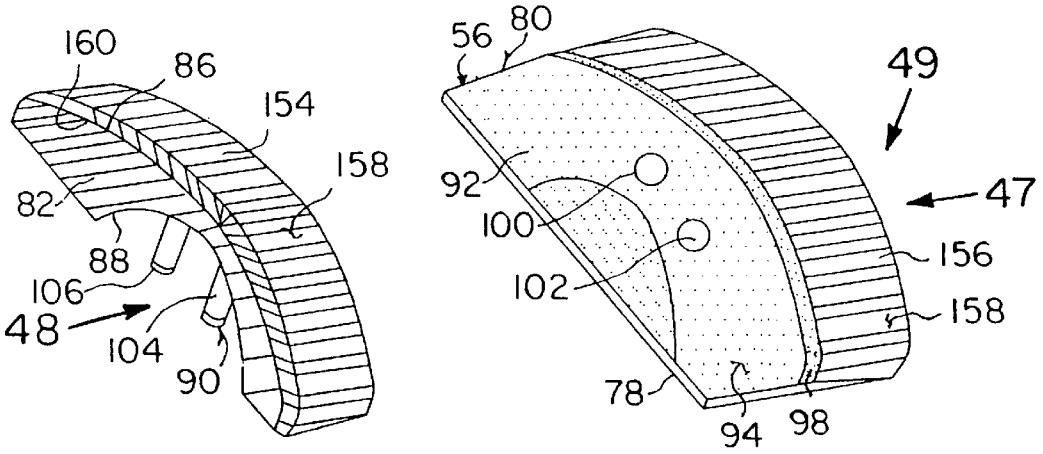
FIG. 46
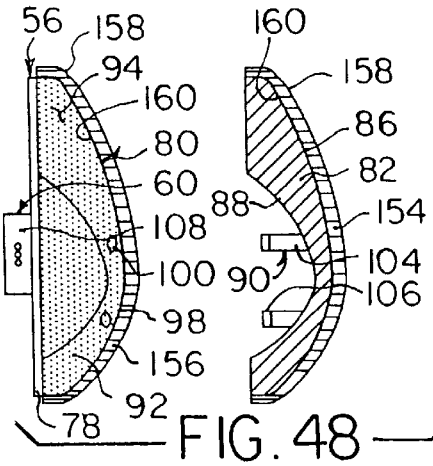
FIG. 48
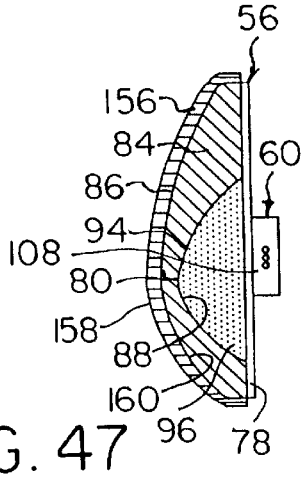
FIG. 47
FIG. 49
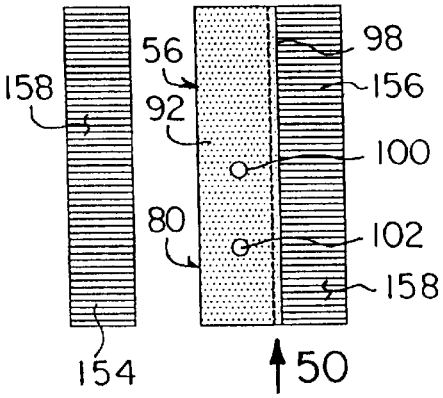
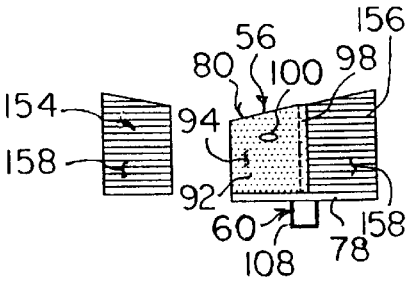
FIG. 50

ABDOMINAL EXERCISE APPARATUS FEATURING PRESTRETCHING AND WEIGHT TRAINING FACILITIES

BACKGROUND OF THE INVENTION

1. Field of the Invention

The instant invention relates generally to exercise devices and more specifically it relates to an abdominal exercise apparatus. The abdominal exercise apparatus will efficiently exercise all the muscles of the midsection of the body.

2. Description of the Prior Art

Numerous exercise devices have been provided in prior art. For example, U.S. Pat. No. 4,372,553 to Hatfield; U.S. Pat. No. 5,120,052 to Evans; U.S. Pat. No. 5,470,291 to Pekkanen and U.S. Pat. No. 5,542,898 to Wilkinson all are illustrative of such prior art. While these units may be suitable for the particular purpose to which they address, they would not be as suitable for the purposes of the present invention as heretofore described.

HATFIELD, FREDERICK C.

WEIGHT LIFTING DEVICE AND METHOD OF EXERCISING

U.S. Pat. No. 4,372,553

An exercising system for exercising the abdominal muscles in which the abdominal muscles are isolated and placed "on stretch" prior to contracture comprising an exercising device having a seat with a posteriorly curved, firm back in which the user sits and secures himself and bends forward working against a progressive force resistance system using weights supported on a pulley system or using a resilient, stretch material connected by means of shoulder harness with straps to the upper shoulder portions of the user, with the user strapped into place with a seat belt. In use, the exerciser simply straps himself into the seat, puts the shoulder harness on and lies back against the posteriorly curved back which puts the abdominals in stretch. Then, by "crunching" the entire upper torso forward (as though an attempt were being made to put the face on the knees), the resisting weights are moved or the material stretched and the abdominals are exercised in isolation, with the exercise repeated as long as desired.

EVANS, LAYNE

ABDOMINAL EXERCISE APPARATUS THAT PROVIDES FOR INCREASED ELONGATION OF THE ABDOMINAL MUSCLES

U.S. Pat. No. 5,129,052

This apparatus is for the development of the abdominal muscles through their ranges of motion including that known as elongation. The objective of the apparatus is to build muscle power and endurance, not only when the abdominal muscles are mostly contracted, but also when the abdominal muscles are mostly elongated. The apparatus includes an outward arch which fits under the upper lumbar and lower thoracic spine. One slope of the arch provides the user's pelvis and lumbar spin with consistent support. The rest of the arch provides the user's remaining spine to be supported when resting, but to be free to arch beyond the amount of arch that occurs in normal standing posture. This exercise is made functional by a knee retainer that holds down on the knees which, in turn, holds down on the pelvis, thereby creating maintainable contact between the pelvis/low-lumbar area and the slope of the arch.

PEKKANEN, OLLI

DEVICE IN A TRAINING APPARATUS

U.S. Pat. No. 5,470,291

A device in an exercising apparatus, comprising a belt or rope in the grip section which the operator grasps. The position is freely adjustable and can be locked in for the duration of the exercise. The mechanism to actuate locking can either be located in the grip section or be installed at the opposite end of the belt. The device is suitable for application in any type of exercising apparatus and is easily adaptable to existing apparatuses.

WILKINSON, WILLIAM T.

MULTIFUNCTION EXERCISE AND AEROBIC BENCH

U.S. Pat. No. 5,542,898

A multifunction exercise and aerobic bench includes an elongated support member having a head end and a foot end. Legs extend below each of the head end and foot ends to elevate the support member. Handles are secured to the support member at the head end and extend upwardly above the support member. The legs at the foot end are movably mounted so that the elevation of the foot end can be lower than the head end to selectively incline the support member. A bar is pivotally mounted at the foot end for moving in an arc.

SUMMARY OF THE INVENTION

A primary object of the present invention is to provide an abdominal exercise apparatus that will overcome the shortcomings of the prior art devices.

Another object is to provide an abdominal exercise apparatus that will make easier weight training for all the muscles of the midsection of the body, which will speed up fat loss, enhance forming of the muscles, increase muscle mass and strengthens the muscles.

An additional object is to provide an abdominal exercise apparatus that will sufficiently prepare, correctly position and isolate the various muscles of the midsection of the body.

A further object is to provide an abdominal exercise apparatus that is simple and easy to use.

A still further object is to provide an abdominal exercise apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 4 is a front perspective view of the pad base structure of FIG. 1.

FIG. 5 is a front view taken in the direction of arrow 5 in FIG. 4.

FIG. 6 is a bottom view taken in the direction of arrow 6 in FIG. 5.

FIG. 7 is a right side view taken in the direction of arrow 7 in FIG. 5.

FIG. 8 is a left side view taken in the direction of arrow 8 in FIG. 4.

FIG. 9 is an exploded front view similar to FIG. 5.

FIG. 10 is an exploded bottom view taken in the direction of arrow 10 in FIG. 9.

FIG. 14 is an exploded front perspective view of the pad base structure of FIG. 11.

FIG. 15 is an exploded right side view taken in the direction of arrow 15 in FIG. 14.

FIG. 16 is a left side view taken in the direction of arrow 16 in FIG. 14.

FIG. 17 is an exploded front view taken in the direction of arrow 17 in FIG. 14.

FIG. 18 is an exploded bottom view taken in the direction of arrow 18 in FIG. 17.

FIG. 22 is an exploded front perspective view of the pad base structure of FIG. 19.

FIG. 23 is a right side view taken in the direction of arrow 23 in FIG. 22.

FIG. 24 is an exploded left side view taken in the direction of arrow 24 in FIG. 22.

FIG. 25 is an exploded front view taken in the direction of arrow 25 in FIG. 22.

FIG. 26 is and exploded bottom view taken in the direction of arrow 26 in FIG. 25.

FIG. 34 is a front perspective view of the pad base structure with both the additional detachable pads and the original detachable pads attached thereto.

FIG. 35 is a front view taken in the direction of arrow 35 in FIG. 34.

FIG. 36 is a bottom view taken in the direction of arrow 36 in FIG. 35.

FIG. 37 is a right side view taken in the direction of arrow 37 in FIG. 35.

FIG. 38 is a left side view taken in the direction of arrow 38 in FIG. 34.

FIG. 39 is an exploded front view similar to FIG. 35.

FIG. 40 is an exploded bottom view taken in the direction of arrow 40 in FIG. 39.

FIG. 41 is an exploded front perspective view of the pad base structure similar to FIG. 14, with the additional right detachable pad attached thereto.

FIG. 42 is an exploded right side view taken in the direction of arrow 42 in FIG. 41.

FIG. 43 is a left side view taken in the direction of arrow 43 in FIG. 41.

FIG. 44 is an exploded front view taken in the direction of arrow 44 in FIG. 41.

FIG. 45 is an exploded bottom view taken in the direction of arrow 45 in FIG. 44.

FIG. 46 is an exploded front perspective view of the pad base structure similar to FIG. 22, with the additional left detachable pad attached thereto.

FIG. 47 is a right side view taken in the direction of arrow 47 in FIG. 46.

FIG. 48 is an exploded left side view taken in the direction of arrow 48 in FIG. 46.

FIG. 49 is an exploded front view taken in the direction of arrow 49 in FIG. 46.

FIG. 50 is an exploded bottom view taken in the direction of arrow 50 in FIG. 49.

Similar reference characters denote corresponding features consistently throughout the attached drawings.

Figure 1:
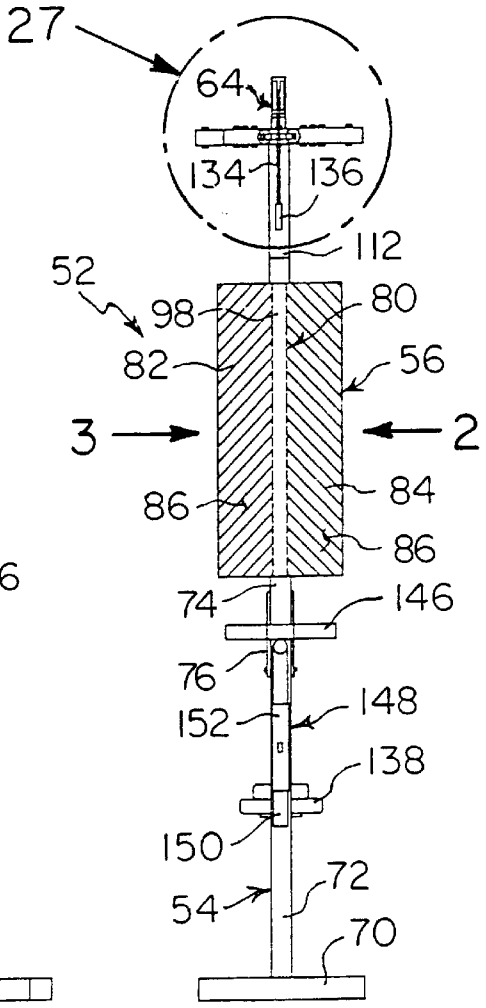
FIG. 1 is a front view of the instant invention positioned for working the rectus abdominus.
Figure 3:
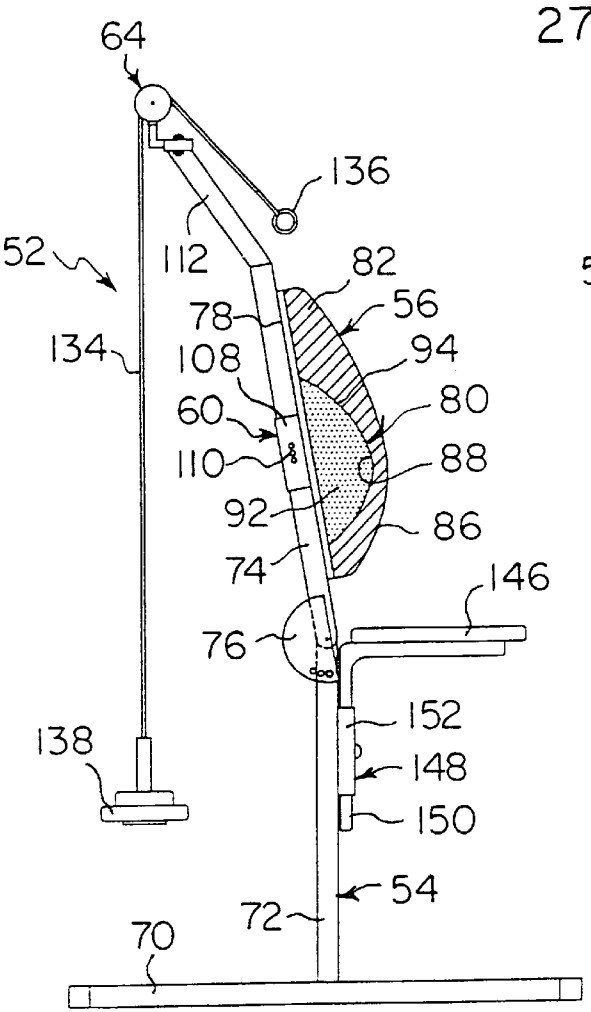
FIG. 3 is a left side view taken in the direction of arrow 3 in FIG. 1.
Figure 2:
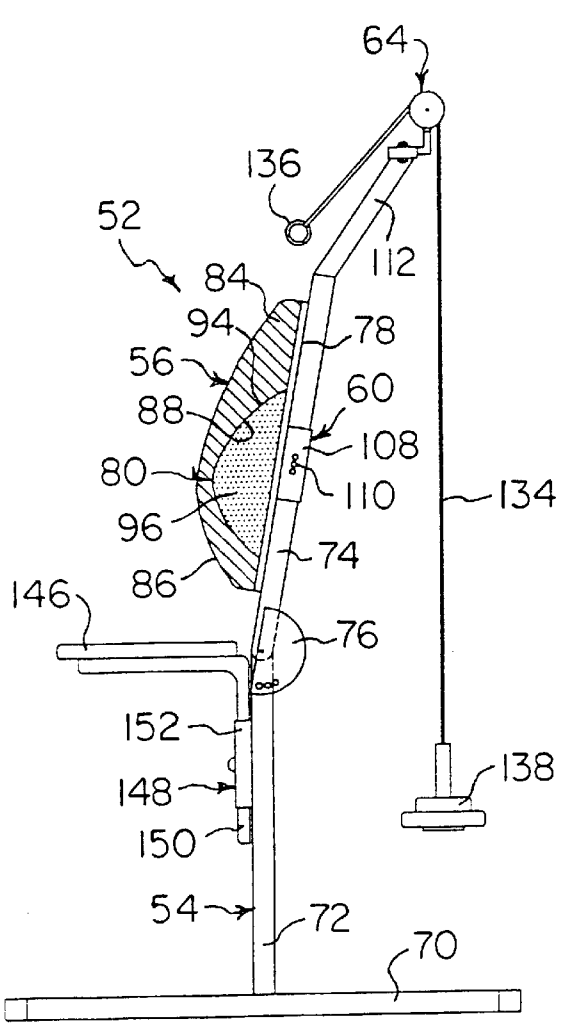
FIG. 2 is a right side view taken in the direction of arrow 2 in FIG. 1.
Figure 13:
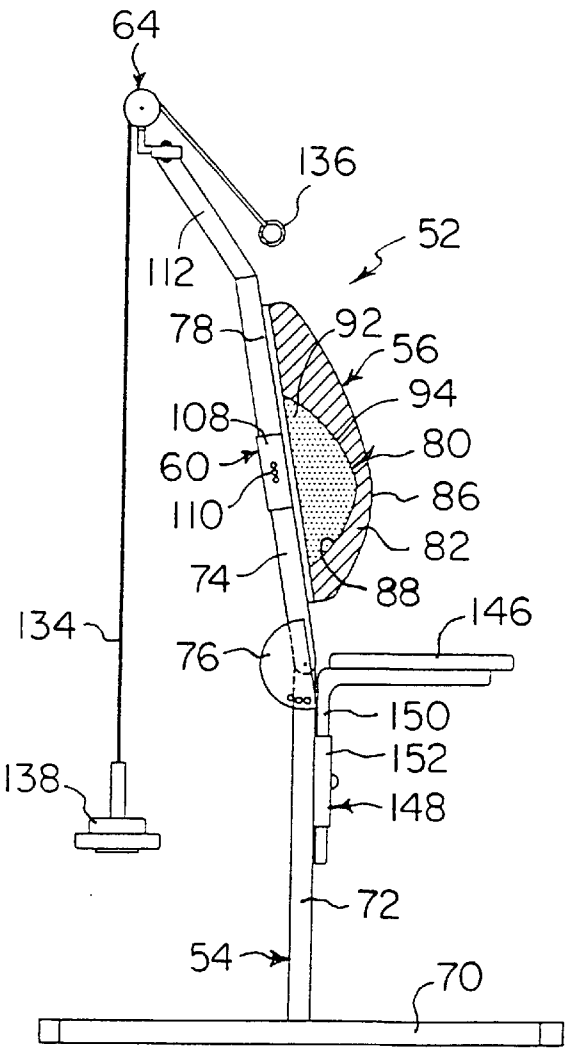
FIG. 13 is a left side view taken in the direction of arrow 13 in FIG. 11.
Figure 12:
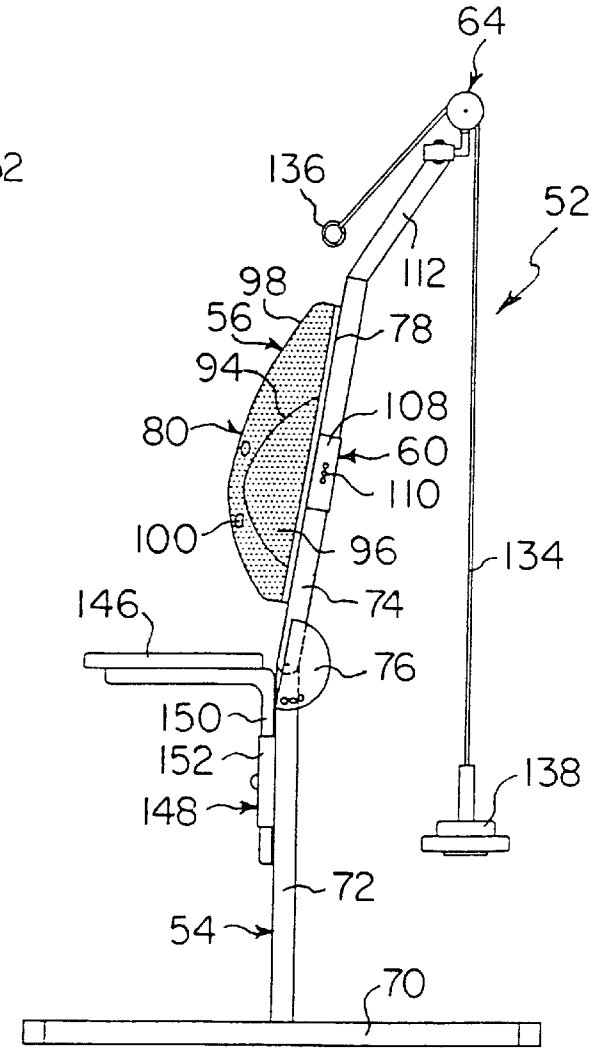
FIG. 12 is a right side view taken in the direction of arrow 12 in FIG. 11.
Figure 11:
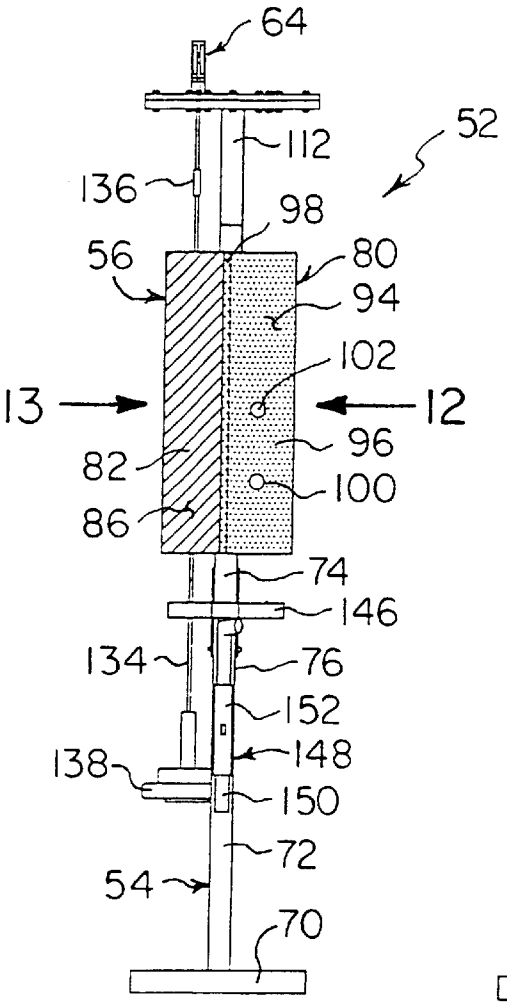
FIG. 11 is a front view of the instant invention positioned for working the right obliques.
Figure 19:
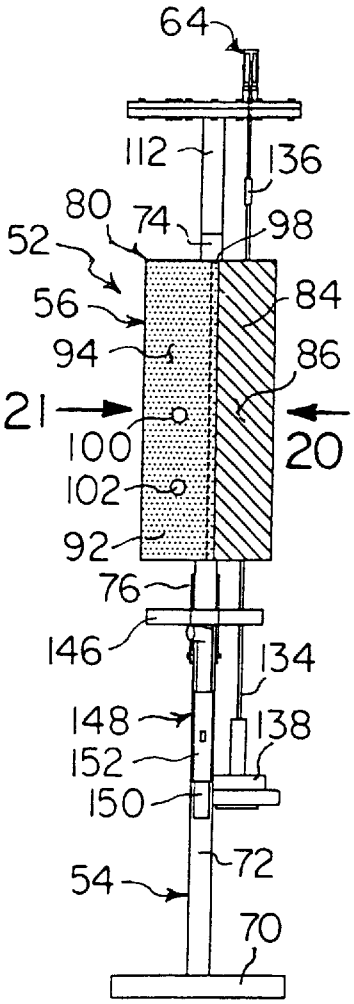
FIG. 19 is a front view of the instant invention positioned for working the left obliques.
Figure 21:
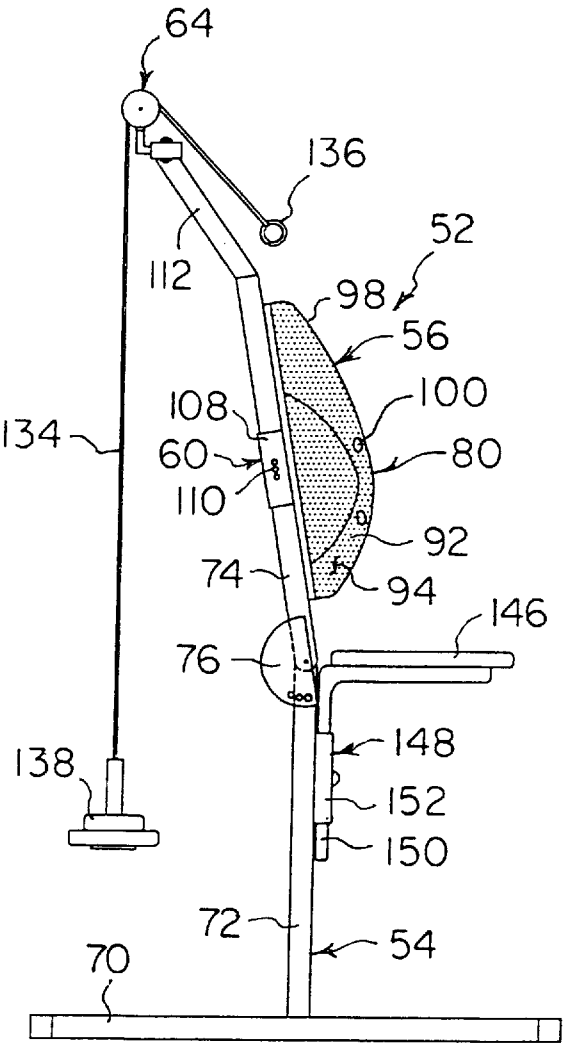
FIG. 21 is a left side view taken in the direction of arrow 21 in FIG. 19.
Figure 20:
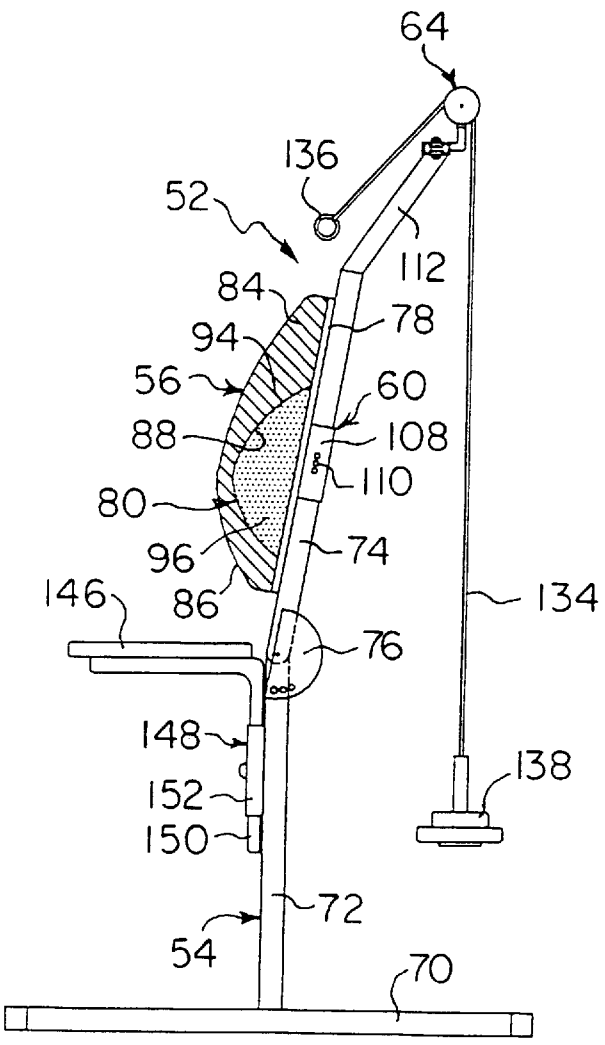
FIG. 20 is a right side view taken in the direction of arrow 20 in FIG. 19.

DETAILED DESCRIPTION OF THE PREFERRED EMBODIMENTS turning now descriptively to the drawings, in which similar reference characters denote similar elements throughout the several views, the Figures illustrate an abdominal exercise apparatus 52 of the present invention. With regard to the reference numerals used, the following numbering is used throughout the various drawing figures.

52 abdominal exercise apparatus
54 adjustable upright stand of 52
56 multi-contoured back pad base structure of 52
58 person
60 component of 52
62 back of 58
64 force resistance assembly of 52

66 connecting facility of 52
68 upper body of 58
70 foot plate of 54
72 vertical leg of 54
74 understructure bar of 54
76 lock connector of 54
78 platform of 56
80 pad base of 56
82 left contoured pad of 56
84 right contoured pad of 56
86 convex top surface on 82, 84
88 concave bottom surface on 82, 84
90 attaching elements
92 left side end of 80
94 convex surface of 92, 96
96 right side end of 80
98 middle segment of 80
100 hole in 92, 96
102 magnetic pad in 100
104 cylindrical pin of 90
106 magnetic tip on 104
108 hollow tube of 60
110 fastener of 60
112 arm of 64
114 grooved bar of 64
116 hole in 114
118 L-shaped extension of 64
120 T-formation end of 118
122 aperture in 120
124 wheel of 64
126 pin of 64
128 swivel member of 64
130 casing of 64
132 pulley of 64
134 elongate cable of 64
136 ring on 134 of 64
138 weight on 134 of 64
140 hook strap vest of 66
142 hook on 140 of 66
144 neck of 58
146 seat of 52
148 attaching assemblage of 52
150 post of 146 of 148
152 sleeve of 148
154 additional left contoured pad
156 additional right contoured pad
158 convex top surface on 154, 156
160 concave bottom surface on 154, 156

The abdominal exercise apparatus 52 comprises an adjustable upright stand 54. A multi-contoured back pad base structure 56 is for positioning, preparing and isolating various muscles of the abdomen of a person 58 during exercise. A component 60 is for mounting the multi-contoured back pad base structure 56 to the adjustable upright stand 54, so that a back 62 of the person 58 can be placed against the multi-contoured back pad base structure 56. A force resistance assembly 64 is affixed onto a top end of the adjustable upright stand 54. A facility 66 is for connecting an upper body 68 of the person 58 to the force resistance assembly 64. When the person 58 moves forwardly away from the multi-contoured back pad base structure 56, the force resistance assembly 64 will apply a force resistance to the upper body 68 of the person 58, to exercise the abdominal muscles of the person 58.

The adjustable upright stand 54 includes an elongated horizontal foot plate 70 which sits upon a floor. A vertical leg 72 is attached to the foot plates 70. An understructure bar 74 is provided. A lock connector 76 is between a top end of the vertical leg 72 and a bottom end of the understructure bar 74, so as to maintain the understructure bar 74 at any desired angle with respect to the floor for an exercise requirement for the person 58.

The multi-contoured back pad base structure 56 consists of a platform 78, with a pad base 80 on the platform 78. Left and right contoured pads 82, 84 are provided, with each having a convex top surface 86 and a concave bottom surface 88. Elements 90 are for attaching the left and right contoured pads 82, 84 to the pad base 80 in a detachable manner, in three different combinations, so as to prestretch the rectus abdominus, the left obliques and the right obliques, as per exercise requirement.

The pad base 80 comprises a left side end 92 having a convex surface 94, with a right side end 96 having a convex surface 94. A middle segment 98 is between the left side end 92 and the right side end 96 with the respective convex surfaces 94 sloping away from the middle segment 98, so as to allow one half of the back 62 of the person 58 to decline onto either of the respective convex surfaces 94.

The attaching elements 90 include the left side end 92 of the pad base 80 having a pair of holes 100 therein. The right side end 96 of the pad base 80 has a pair of holes 100 therein. Four magnetic pads 102 are provided. The magnetic pads 102 are inserted into the bottom of the holes 100 in the left side end 92 and into bottom of the holes 100 in the right side end 96 of the pad base 80. Four cylindrical pins 104 are also provided, with each cylindrical pin 104 having a magnetic tip 106. Two cylindrical pins 104 extend from the concave bottom surface 88 of the left contoured pad 82 to be received in the holes 100 in the left side end 92 of the pad base 80, so that the two respective magnetic tips 106 will make contact with the two magnetic pads 102. The other two cylindrical pins 104 extend from the concave bottom surface 88 of the right contoured pad 84 to be received in the holes 100 in the right side end 96 of the pad base 80, so that the two respective magnetic tips 106 will make contact with the two magnetic pads 102.

The mounting component 60 consists of a hollow tube 108 mounted to a rear surface of the platform 78. The hollow tube 108 slides on the understructure bar 74 of the adjustable upright stand 54. A fastener 110 is for retaining the hollow tube 108 on the understructure bar 74 in a stationary position.

Figure 28:
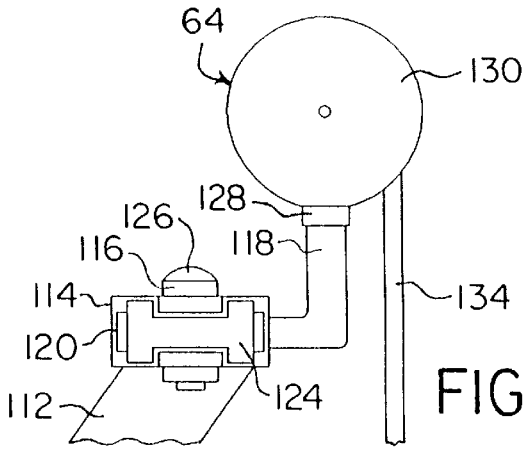
FIG. 28 is a further enlarged right side view taken in the direction of arrow 28 in FIG. 27.
Figure 27:
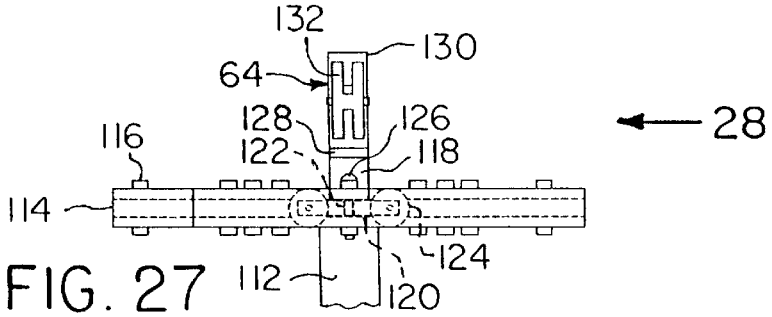
FIG. 27 is an enlarged front view of an area in FIG. 1 indicated by arrow 27, showing the sliding pulley in the grooved column in greater detail.
Figure 29:
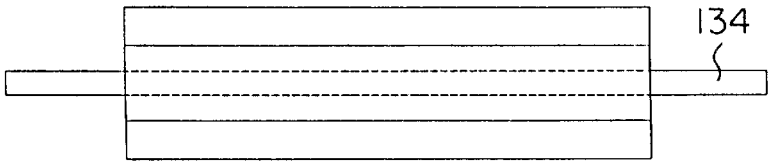
FIG. 29 is a top view of the padding attached to the cable with VELCRO.
Figure 30:
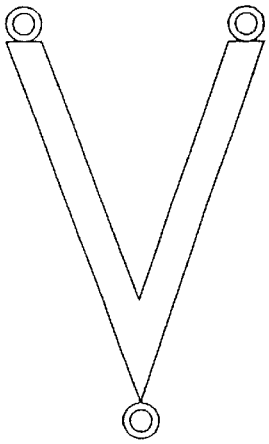
FIG. 30 is an elevational view of the V-shaped strap with rings at its ends.
Figure 31:
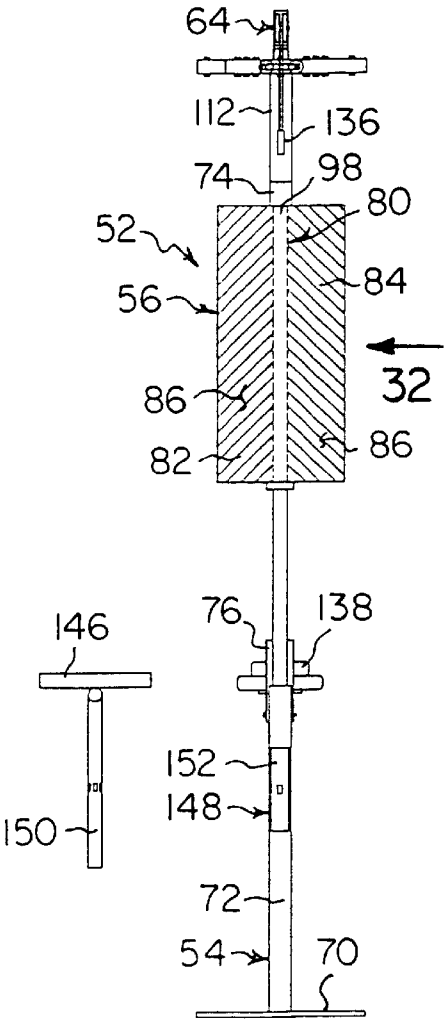
FIG. 31 is a front view of the instant invention, showing the seat removed therefrom and positioned for working from a standing posture.
Figure 32:
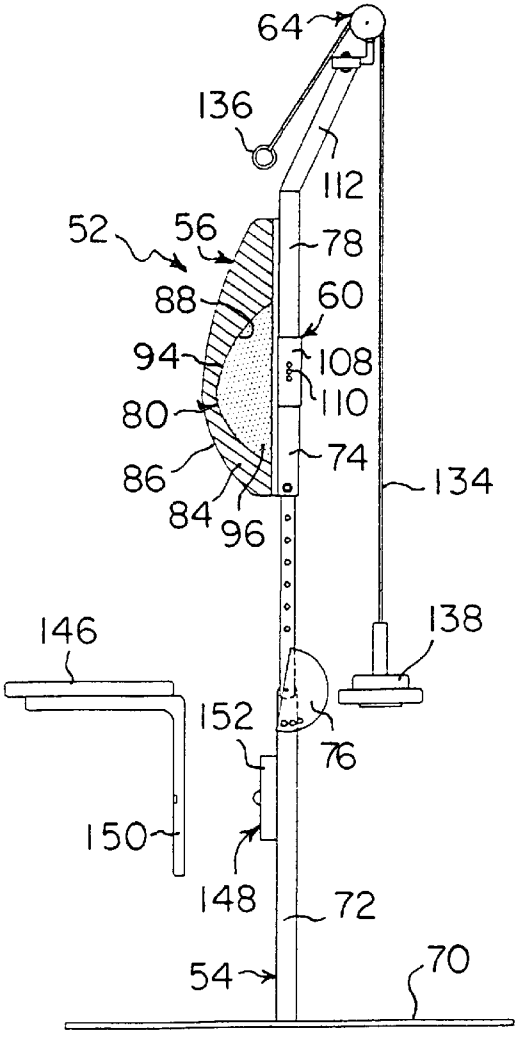
FIG. 32 is a right side view taken in the direction of arrow 32 in FIG. 31.
Figure 33:
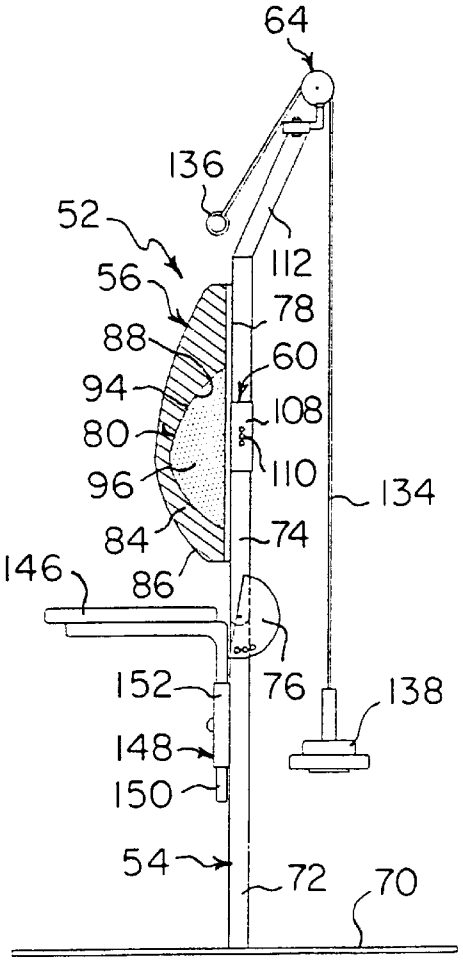
FIG. 33 is a right side view similar to FIG. 32 with the seat installed and height adjusted to a lower position.

The force resistance assembly 64, as best seen in FIGS. 27 and 28, comprises an arm 112 angularly affixed to a top end of the understructure bar 74 of the adjustable upright stand 54. A grooved bar 114 is transversely mounted across a top end of the arm 112. The grooved bar 114 has a plurality of spaced apart holes 116 therethrough. An L-shaped extension 118 with a T-formation end 120 has an aperture 122 therethrough. A plurality of wheels 124 are carried on the T-formation end 120 of the L-shaped extension 118, which ride within the grooved bar 114. A pin 126 extends through any one of the holes 116 in the grooved bar 114 and the aperture 122 in the T-formation end 120 of the L-shaped extension 118, as per exercise requirement. A swivel member 128 is on a top end of the L-shaped extension 118, with a casing 130 on the swivel member 128. A pulley 132 is rotatively carried within the casing 130. An elongate cable 134 extends over the pulley 132. A ring 136 is affixed to an upper end of the elongate cable 134, while a weight 138 is affixed to a lower end of the elongate cable 134.

Figure 51:
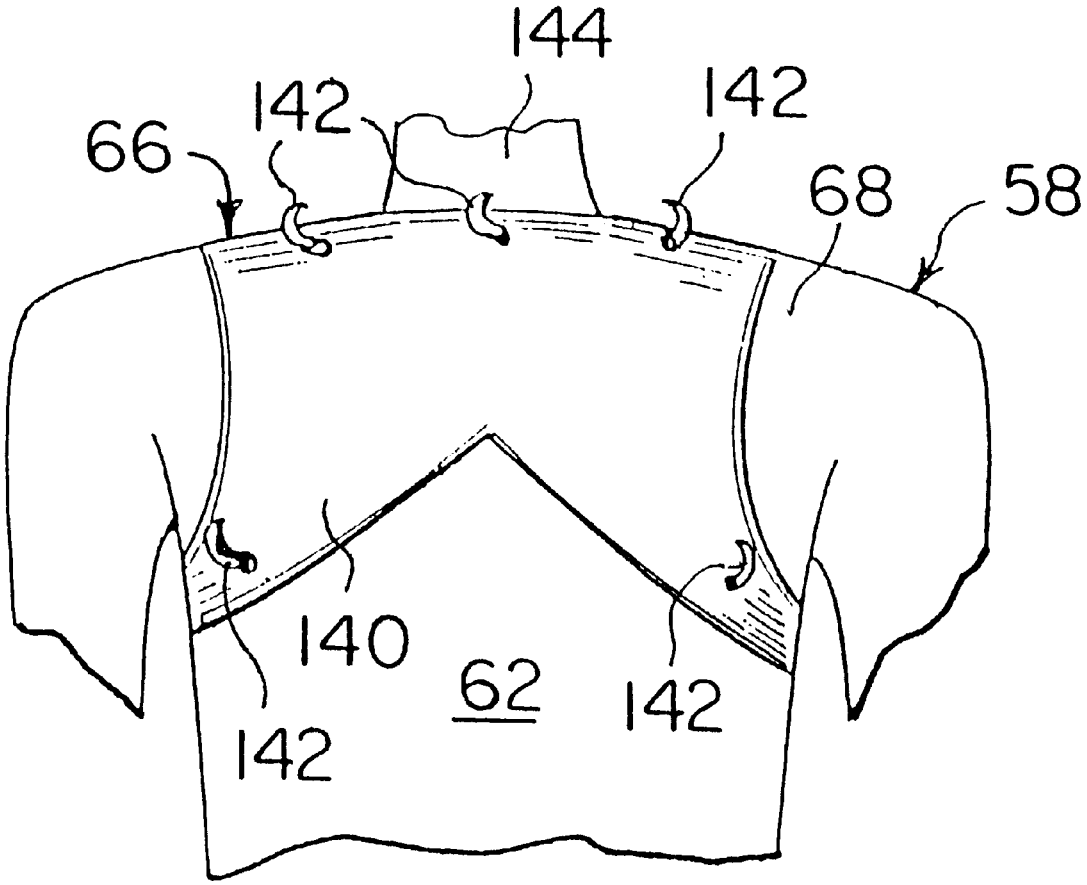
FIG. 51 is a rear perspective view of a person with parts broken away, wearing the hook strap.

The connecting facility 66, as shown in FIG. 51, includes a hook strap vest 140 worn on the upper body 68 of the person 58. Five hooks 142 are affixed to the hook strap vest 140. Each of the hooks 142 engages the ring 136 on the upper end of the elongate cable 134, when performing the various exercises. Two of the hooks 142 located on the upper left and upper right on the hook strap vest 40 can be used for the oblique abdominal exercises. Two of the hooks 142 located at a lower portion of the hook strap vest 140 can be used for the transverse abdominal exercises. The hook 142 located directly behind the neck 144 of the person 58 can be used for the rectus abdominal exercise.

The abdominal exercise apparatus 52 further contains a seat 146 and an assemblage 148 for attaching the seat 146 to the vertical leg 72 of the adjustable upright stand 54 in a horizontal swivel locking manner below the multi-contoured back pad base structure 56, so that the person 58 can sit upon the seat 146 to exercise the abdominal muscles.

The attaching assemblage 148 includes the seat 146 having a post 150 which is parallel to the vertical leg 72 of the adjustable upright stand 54. A sleeve 152 is affixed at one side to the vertical leg 72, to receive the post 150 of the seat 146. The post 150 can swivel within the sleeve 152, so as to position the seat 146 with respect to the vertical leg 72 as per exercise requirement.

The abdominal exercise apparatus 52, as shown in FIGS. 34 to 50, can further contain additional left and right contoured pads 154, 156, with each having a convex top surface 158 and a concave bottom surface 160. The additional left and right contoured pads 154, 156 can be connected in a detachable manner to the respective left and right contoured pads 84, 86 to increase the arching of the back 62 of the person 58 when exercising.

The multi-contoured back pad base structure 56 can be partially substituted by two hollow metal arches having the same curvature dimensions as the detachable pads 82, 84 with each arch, two and a half inches wide and merely a half inch apart from one another when kept upright. These arches can be based on a conventional abdominal "situp" board with curved niches to accommodate the arches and the lower end of the board can be made to provided seating adjustability. The understructure of the board accommodates a detachable tubular bar which extends to centrally meet the grooved bar 14 containing the sliding pulley 132. The leg-support of the board can be made to fold back to the understructure, to provide for cable and weight space. The leg of the board can be made to provide an upright stance, the seat at the lower end of the board is positioned upright and the sliding pulley 132 in grooved bar 114 facility can be slid into the understructure to make for weight resisted crunches. When both arches are kept upright together they exercise the rectus abdominus and when kept upright singularly, they facilitate obliques exercises.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An abdominal exercise apparatus comprising:

a) an upright stand;

b) a multi-contoured back pad base structure for positioning, preparing and isolating various muscles of a person's abdomen during exercise; said multi-contoured back pad base structure including: a platform; a pad base on said platform; left and right contoured pads, each having a convex top surface and a concave bottom surface; means for attaching said left and right contoured pads to said pad base in a detachable manner, in three different combinations, so as to prestretch a person's rectus abdominus, left obliques and right obliques, as per exercise requirement; said pad base including; a left side end having a convex surface; a right side end having a convex surface; and a middle segment between said left side end and said right side end, with said respective convex surfaces sloping away from said middle segment, so as to allow one half of a person's back to recline onto either of said respective convex surfaces;

c) means for mounting said multi-contoured back pad base structure to said upright stand, so that a person's back can be placed against said multi-contoured back pad base structure;

d) a force resistance assembly affixed onto a top end of said upright stand; and e) means for connecting a person's upper body to said force resistance assembly so that when the person moves forwardly away from said multi-contoured back pad base structure, said force resistance assembly will apply a force resistance to the upper body of the person, to exercise the person's abdominal muscles.

2. An abdominal exercise apparatus as recited in claim 1, wherein said attaching means includes:

a) said left side end of said pad base having a pair of holes therein;

b) said right side end of said pad base having a pair of holes therein;

c) four magnetic pads, wherein said magnetic pads are inserted respectively into bottoms of said holes in said left side end and in said right side end of said pad base;

d) four cylindrical pins, with each said cylindrical pin having a magnetic tip, whereby two said cylindrical pins extend from said concave bottom surface of said left contoured pad to be received in said holes in said left side end of said pad base, so that said two respective magnetic tips will make contact with said two magnetic pads, while the other two said cylindrical pins extend from said concave bottom surface of said right contoured pad to be received in said holes in said right side end of said pad base, so that said two respective magnetic tips will make contact with said two magnetic pads.

3. An abdominal exercise apparatus as recited in claim 1, further including additional left and right contoured pads, each having a convex top surface and a concave bottom surface, said additional left and right contoured pads being connected in a detachable manner to said respective left and right contoured pads to increase arching of a person's back when exercising.

4. An abdominal exercise apparatus as recited in claim 1, wherein said upright stand includes:

a) an elongated horizontal foot plate which sits upon a floor;

b) a vertical leg attached to said foot plate;

c) an understructure bar; and d) a lock connector between a top end of said vertical leg and a bottom end of said understructure bar, so as to maintain said understructure bar at any desired angle with respect to the floor as per exercise requirement.

5. An abdominal exercise apparatus as recited in claim 2, wherein said mounting means includes:

a) a hollow tube mounted to a rear surface of said platform, said hollow tube sliding on said understructure bar of said upright stand; and b) a fastener for retaining said hollow tube on said understructure bar in a stationary position.

6. An abdominal exercise apparatus as recited in claim 4, wherein said force resistance assembly includes:

a) an arm angularly affixed to a top end of said understructure bar of said upright stand;

b) a grooved bar transversely mounted across a top end of said arm, said grooved bar having a plurality of spaced apart holes therethrough;

c) an L-shaped extension with a T-formation end having an aperture therethrough;

d) a plurality of wheels carried on said T-formation end of said L-shaped extension which ride within said grooved bar;

e) a pin to extend through one of said holes in said grooved bar and said aperture in said T-formation end of said L-shaped extension, as per exercise requirement;

f) a swivel member on a top end of said L-shaped extension;

g) a casing on said swivel member;

h) a pulley rotatively carried within said casing;

i) an elongate cable extending over said pulley;

j) a ring affixed to an upper end of said elongate cable; and k) a weight affixed to a lower end of said elongate cable.

7. An abdominal exercise apparatus as recited in claim 6, wherein said connecting means includes:

a) a hook strap vest to be worn on a person's upper body; and b) five hooks affixed to said hook strap vest for engaging said ring on the upper end of said elongate cable, two of said hooks being located respectively on upper left and upper right portions on said hook strap vest for oblique abdominal exercises, two of said hooks being located at a lower portion of said hook strap vest for transverse abdominal exercises, and one said hook being located centrally on said hook strap vest for rectus abdominal exercise.

8. An abdominal exercise apparatus as recited in claim 4, further including:

a) a seat; and b) means for attaching said seat to said vertical leg of said upright stand in a horizontal swivel locking manner below said multi-contoured back pad base structure, so that a person can sit upon said seat to exercise their abdominal muscles.

9. An abdominal exercise apparatus as recited in claim 8, wherein said seat attaching means includes:

a) said seat having a post which is parallel to said vertical leg of said upright stand; and b) a sleeve affixed at one side to said vertical leg to receive said post of said seat, whereby said post can swivel within said sleeve, so as to position said seat with respect to said vertical leg as per exercise requirement.

10. An abdominal exercise apparatus as recited in claim 4, wherein said attaching means includes:

a) said left side end of said pad base having a pair of holes therein;

b) said right side end of said pad base having a pair of holes therein;

c) four magnetic pads, wherein said magnetic pads are inserted respectively into bottoms of said holes in said left side end and in said right side end of said pad base;

d) four cylindrical pins, with each said cylindrical pin having a magnetic tip, whereby two said cylindrical pins extend from said concave bottom surface of said left contoured pad to be received in said holes in said left side end of said pad base, so that said two respective magnetic tips will make contact with said two magnetic pads, while the other two said cylindrical pins extend from said concave bottom surface of said right contoured pad to be received in said holes in said right side end of said pad base, so that said two respective magnetic tips will make contact with said two magnetic pads.

11. An abdominal exercise apparatus as recited in claim 10, wherein said mounting means includes:

a) a hollow tube mounted to a rear surface of said platform, said hollow tube sliding on said understructure bar of said upright stand; and b) a fastener for retaining said hollow tube on said understructure bar in a stationary position.

12. An abdominal exercise apparatus as recited in claim 11, wherein said force resistance assembly includes:

a) an arm angularly affixed to a top end of said understructure bar of said upright stand;

b) a grooved bar transversely mounted across a top end of said arm, said grooved bar having a plurality of spaced apart holes therethrough;

c) an L-shaped extension with a T-formation end having an aperture therethrough;

d) a plurality of wheels carried on said T-formation end of said L-shaped extension which ride within said grooved bar;

e) a pin to extend through one of said holes in said grooved bar and said aperture in said T-formation end of said L-shaped extension, as per exercise requirement;

f) a swivel member on a top end of said L-shaped extension;

g) a casing on said swivel member;

h) a pulley rotatively carried within said casing;

i) an elongate cable extending over said pulley;

j) a ring affixed to an upper end of said elongate cable; and k) a weight affixed to a lower end of said elongate cable.

13. An abdominal exercise apparatus as recited in claim 12, wherein said connecting means includes:

a) a hook strap vest to be worn on a person's upper body; and b) five hooks affixed to said hook strap vest for engaging said ring on the upper end of said elongate cable, two of said hooks being located respectively on upper left and upper right portions on said hook strap vest for oblique abdominal exercises, two of said hooks being located at a lower portion of said hook strap vest for transverse abdominal exercises, and one said hook being located centrally on said hook strap vest for rectus abdominal exercise.

14. An abdominal exercise apparatus as recited in claim 13, further including:

a) a seat; and b) means for attaching said seat to said vertical leg of said upright stand in a horizontal swivel locking manner below said multi-contoured back pad base structure, so that a person can sit upon said seat to exercise their abdominal muscles.

15. An abdominal exercise apparatus as recited in claim 14, wherein said seat attaching seat means includes:

a) said seat having a post which is parallel to said vertical leg of said upright stand; and b) a sleeve affixed at one side to said vertical leg to receive said post of said seat, whereby said post can swivel within said sleeve, so as to position said seat with respect to said vertical leg as per exercise requirement.

16. An abdominal exercise apparatus as recited in claim 15, further including additional left and right contoured pads, each having a convex top surface and a concave bottom surface, said additional left and right contoured pads being connected in a detachable manner to said respective left and right contoured pads to increase arching of the a person's back when exercising.

* * * * *